US007942714B2

(12) United States Patent
Kang et al.

(10) Patent No.: US 7,942,714 B2
(45) Date of Patent: May 17, 2011

(54) METHOD OF MANUFACTURING FIELD EMISSION DEVICE

(75) Inventors: Ho-Suk Kang, Yongin-si (KR); Yong-Wan Jin, Yongin-si (KR); Sun-Il Kim, Yongin-si (KR); Deuk-Seok Chung, Yongin-si (KR); Byong-Gwon Song, Yongin-si (KR); Shang-Hyeun Park, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 339 days.

(21) Appl. No.: 11/790,657

(22) Filed: Apr. 26, 2007

(65) Prior Publication Data

US 2008/0108271 A1 May 8, 2008

(30) Foreign Application Priority Data

Nov. 6, 2006 (KR) ..... 10-2006-0108836

(51) Int. Cl.
*H01J 9/02* (2006.01)
*H01J 1/304* (2006.01)

(52) U.S. Cl. ..... 445/24; 445/51; 313/495; 313/496; 313/497

(58) Field of Classification Search ..... 445/23–25, 445/49–51

See application file for complete search history.

(56) References Cited

U.S. PATENT DOCUMENTS

| | | | | |
|---|---|---|---|---|
| 5,493,173 | A * | 2/1996 | Imura | 313/306 |
| 5,578,896 | A * | 11/1996 | Huang | 313/309 |
| 5,827,099 | A * | 10/1998 | Spindt et al. | 445/24 |
| 6,062,931 | A * | 5/2000 | Chuang et al. | 445/24 |
| 6,504,292 | B1 * | 1/2003 | Choi et al. | 313/310 |
| 2004/0080260 | A1 * | 4/2004 | Park et al. | 313/495 |
| 2005/0040752 | A1 * | 2/2005 | Lee et al. | 313/495 |
| 2007/0275627 | A1 * | 11/2007 | Jung et al. | 445/51 |

* cited by examiner

*Primary Examiner* — Bumsuk Won
*Assistant Examiner* — Nathaniel J Lee
(74) *Attorney, Agent, or Firm* — Cantor Colburn LLP

(57) ABSTRACT

A method of manufacturing a field emission display includes: sequentially forming a cathode electrode, an insulating layer, and a gate material layer on a substrate; forming a metal sacrificial layer on an upper surface of the gate material layer; forming a through hole to expose the insulating layer in the metal sacrificial layer and the gate material layer; forming an emitter hole to expose the cathode electrode in the insulating layer exposed through the through hole; forming a gate electrode by etching the gate material layer constituting an upper wall of the emitter hole; and forming an emitter of Carbon NanoTubes (CNTs) on an upper surface of the cathode electrode located below the through hole.

33 Claims, 8 Drawing Sheets

METHOD OF MANUFACTURING FIELD EMISSION DEVICE

CLAIM OF PRIORITY

This application makes reference to, incorporates the same herein, and claims all benefits accruing under 35 U.S.C.§119 from an application for METHOD OF MANUFACTURING FIELD EMISSION DEVICE earlier filed in the Korean Intellectual Property Office on the 6 Nov. 2006 and there duly assigned Serial No. 10-2006-0108836.

BACKGROUND OF THE INVENTION

1. Field of the Invention

The present invention relates to a method of manufacturing a field emission device, and more particularly, the present invention relates to a method of manufacturing a field emission device having an increased lifetime by preventing the degradation of Carbon NanoTubes (CNTs).

2. Description of the Related Art

A field emission device emits electrons from emitters formed on a cathode electrode by forming a strong electric field around the emitters. An example of an application of a field emission device is a Field Emission Display (FED), which displays an image using visible light generated by the collision of electrons emitted from the field emission device to a phosphor layer formed on an anode electrode. Due to the excellent characteristics of FEDs, such as thinness, that is, an overall thickness of an FED is only a few cm, a large viewing angle, low power consumption, and low manufacturing costs, FEDs are expected to be one of the next generation display devices together with Liquid Crystal Displays (LCDs) and Plasma Display Panels (PDPs).

The FEDs can also be used in a BackLight Unit (BLU) of an LCD that displays an image on a front surface of the LCD when light emitted by a light source located in the rear of the LCD is transmitted through liquid crystals that control the rate of optical transmittance of the light. The light source located in the rear of the LCD can be a Cold Cathode Fluorescence Lamp (CCFL), an External Electrode Fluorescence Lamp (EEFL), or a Light Emitting Diode (LED). Besides these, a field emission type backlight unit can also be used as the light source. The field emission type backlight unit in principle has an identical driving mechanism and a light emission mechanism as the field emission device. However, the difference is that the field emission type backlight unit does not display an image but only functions as a light source. Due to its thinness, low manufacturing costs, and location-selective brightness control function, the field emission type backlight unit is expected to be a next generation backlight unit for LCDs. The field emission devices can also be applied to various systems that use electron emission, such as X-ray tubes, microwave amplifiers, flat panel lamps, and the like.

A micro tip formed of a metal, such as molybdenum Mo, is conventionally used as an emitter to emits electrons in a field emission device. However, Carbon NanoTubes (CNTs) having high electron emission characteristics are now mainly used as electron emitters. Field emission devices that use CNT emitters have advantages of low manufacturing costs, a low driving voltage, and high chemical and mechanical stability. The CNT emitters can be formed in a paste form or by directly growing the CNTs using a Chemical Vapor Deposition (CVD) method. The forming of the CNTs in a paste form has a drawback in that the lifetime of the field emission device is reduced since the CNTs are degraded in the process of removing an organic material and a binder that constitute the paste. The method of direct growing of the CNTs has an advantage in that the degradation of the CNTs can be prevented since an organic material or a binder that constitute the paste is not employed in this method. However, due to a high growing temperature and complicated synthesizing conditions, mass production is difficult.

SUMMARY OF THE INVENTION

The present invention provides a method of manufacturing a field emission device having an increased lifetime by preventing the degradation of Carbon NanoTubes (CNTs).

According to one aspect of the present invention, a method of manufacturing a field emission device is provided, the method including: sequentially forming a cathode electrode, an insulating layer, and a gate material layer on a substrate; forming a metal sacrificial layer on an upper surface of the gate material layer; forming a through hole to expose the insulating layer in the metal sacrificial layer and the gate material layer; forming an emitter hole to expose the cathode electrode in the insulating layer exposed through the through hole; forming a gate electrode by etching the gate material layer constituting an upper wall of the emitter hole; and forming an emitter of CNTs on an upper surface of the cathode electrode located below the through hole.

The gate material layer is preferably formed of a material having etch selectivity with respect to the cathode electrode and the metal sacrificial layer.

The through hole is preferably formed by etching a predetermined portion of each of the metal sacrificial layer and the gate material layer until the insulating layer is exposed. The through hole is preferably formed at a location corresponding to a location where the emitter is formed.

The emitter hole is preferably formed by etching the insulating layer exposed by the through hole until the cathode electrode is exposed. The insulating layer is preferably etched by an isotropical etching method.

Forming the emitter preferably includes: forming CNTs on upper surfaces of the metal sacrificial layer and the cathode electrode located below the through hole; and removing the metal sacrificial layer and the CNTs formed on the upper surface of the metal sacrificial layer. The method preferably further includes forming an adhesion layer to fix the CNTs on the upper surface of the cathode electrode after the CNTs have been formed. The adhesion layer is preferably formed of at least one metal selected from a group consisting of Ti, Mo, Au, Ag, Al, Ca, Cd, Fe, Ni, Pt, Zn, and Cu. The adhesion layer is preferably formed by an electron beam deposition method.

Forming the CNTs preferably includes: preparing a dispersion solution formed by dispersing the CNTs in a solvent; coating the dispersion solution on upper surfaces of the metal sacrificial layer and the cathode electrode located below the through hole; and removing the solvent by heating the dispersion solution. The solvent is preferably at least one solution selected from a group consisting of water, dimethylorumamaid (DMF), N-methyl-2pyrolidon (NMP), dimethylacetamide (DMAc), cyclohexanon, ethylalcohol, chloroforum, dichloromethane, and ethylether.

The dispersion solution is preferably coated by one of a spray method, a spin coating method, or a dipping method.

The CNTs preferably include CNTs combined with magnetic particles. The magnetic particles are preferably formed of an iron alloy.

The method preferably further includes vertically arranging the CNTs on the surface of the cathode electrode by applying a magnetic field to the CNTs after removing the solvent from the dispersion solution through a heating process. The magnetic field is preferably applied by a permanent magnet arranged below the substrate.

The method preferably further includes forming the adhesion layer for fixing the CNTs on the upper surface of the cathode electrode after vertically arranging the CNTs.

According to another aspect of the present invention, a method of manufacturing a field emission device is provided, the method including: sequentially forming a base electrode, a cathode electrode, an insulating layer, and a gate material layer on a substrate; forming a metal sacrificial layer on an upper surface of the gate material layer; forming a through hole to expose the insulating layer in the metal sacrificial layer and the gate material layer; forming an emitter hole to expose the cathode electrode in the insulating layer exposed through the through hole; forming a cathode hole to exposes the base electrode by etching the cathode electrode constituting a lower wall of the emitter hole and simultaneously forming a gate electrode by etching the gate material layer constituting an upper wall of the emitter hole; and forming an emitter of Carbon NanoTubes (CNTs) on an upper surface of the base electrode located below the through hole.

The cathode electrode and the gate material layer are preferably formed of a material having etch selectivity with respect to the base electrode and the metal sacrificial layer.

The through hole is preferably formed at a location corresponding to a location where the emitter is formed.

Forming the emitter preferably includes: forming CNTs on upper surfaces of the metal sacrificial layer and the base electrode located below the through hole; and removing the metal sacrificial layer and the CNTs formed on the upper surface of the metal sacrificial layer. The method preferably further includes forming an adhesion layer to fix the CNTs on the upper surface of the base electrode after the CNTs have been formed. The adhesion layer is preferably formed of at least one metal selected from a group consisting of Ti, Mo, Au, Ag, Al, Ca, Cd, Fe, Ni, Pt, Zn, and Cu. The adhesion layer is preferably formed by an electron beam deposition method.

Forming the CNTs preferably includes: preparing a dispersion solution formed by dispersing the CNTs in a solvent; coating the dispersion solution on upper surfaces of the metal sacrificial layer and the base electrode located below the through hole; and removing the solvent by heating the dispersion solution. The solvent is preferably at least one solution selected from a group consisting of water, dimethyl formamide (DMF), N-methyl-2-pyrrolidone (NMP), dimethyl acetamide (DMAc), cyclohexanone, ethyl alcohol, chloroform, dichloromethane, and ethyl ether. The dispersion solution is preferably coated by one of a spray method, a spin coating method, or a dipping method.

The CNTs preferably include CNTs combined with magnetic particles. The magnetic particles are preferably formed of an iron alloy.

The method preferably further includes vertically arranging the CNTs on the surface of the base electrode by applying a magnetic field to the CNTs after removing the solvent from the dispersion solution through a heating process. The magnetic field is preferably applied by a permanent magnet arranged below the substrate. The method preferably further includes forming the adhesion layer to fix the CNTs on the upper surface of the base electrode after vertically arranging the CNTs.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
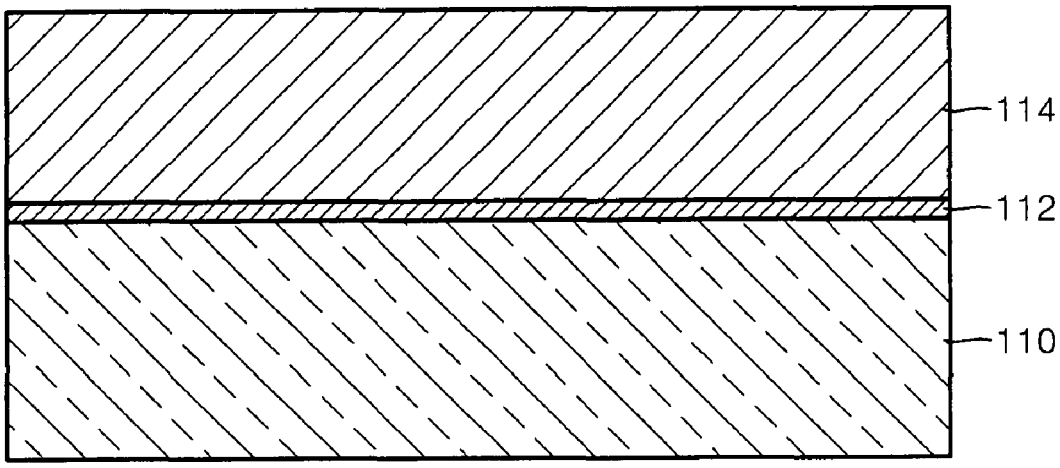
FIGS. 1 through 9 are cross-sectional views of a method of manufacturing a field emission device according to an embodiment of the present invention.

The present invention is described more fully below with reference to the accompanying drawings in which exemplary embodiments of the present invention are shown. In the drawings, the thicknesses of layers and regions are exaggerated for clarity, and like reference numerals refer to the like elements.

FIGS. 1 through 9 are cross-sectional views of a method of manufacturing a field emission device according to an embodiment of the present invention.

Referring to FIG. 1, a cathode electrode 112 and an insulating layer 114 are sequentially formed on a substrate 110. The substrate 110 can be a glass substrate or a plastic substrate. The cathode electrode 112 can be formed by patterning a cathode material (not shown) in a predetermined shape, for example, a stripe shape after depositing the cathode material on an upper surface of the substrate 110. The cathode electrode 112 can be formed of a metal, such as Cr, Ag, Al, or Au, and can also be formed of various other materials. The cathode electrode 112 may be formed of a material having etch selectivity with respect to a material for forming a gate material layer 116 as described later. The insulating layer 114 is formed to a predetermined thickness on the substrate 110 to cover the cathode electrode 112.

Figure 2:
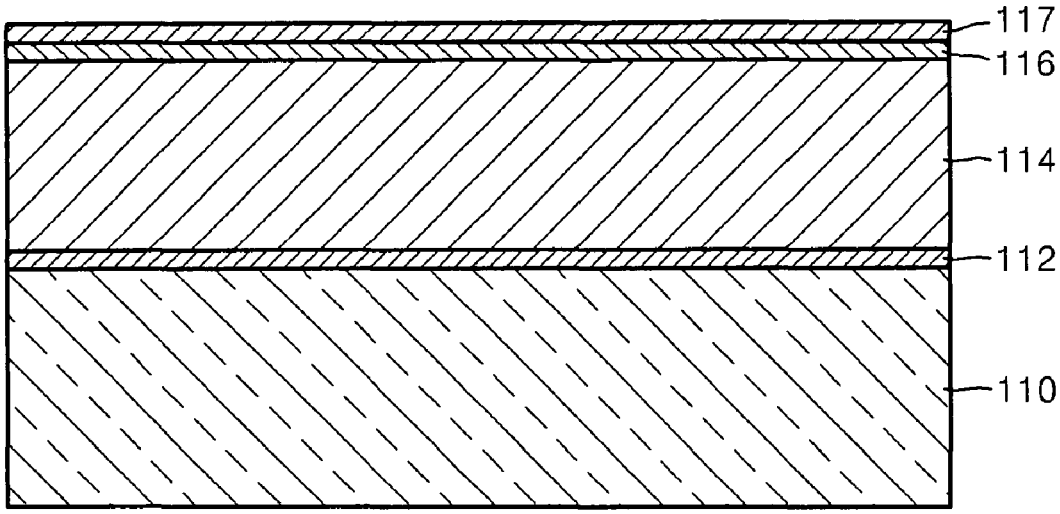

Referring to FIG. 2, a gate material layer 116 and a metal sacrificial layer 117 are sequentially formed on the insulating layer 114. The gate material layer 116 and the metal sacrificial layer 117 can be formed of a metal, for example, Cr, Ag, Al, or Au, and can also be formed of various other materials. The gate material layer 116 may be formed of a material having etch selectivity with respect to the cathode electrode 112 and the metal sacrificial layer 117. For example, if the cathode electrode 112 and the metal sacrificial layer 117 are formed of Cr, the gate material layer 116 may be formed of a material having etch selectivity with respect to Cr.

Figure 3:
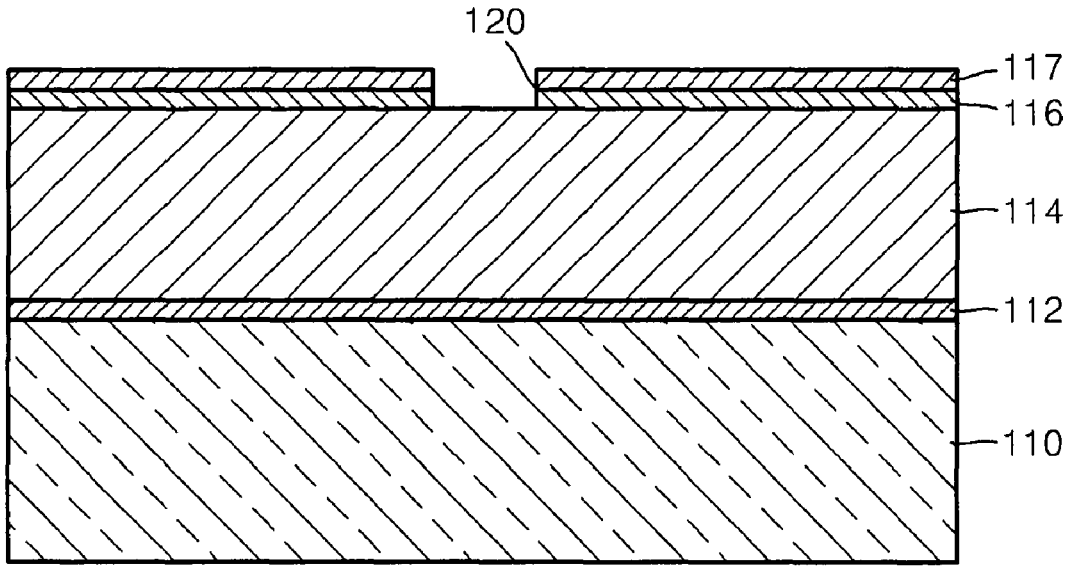
Figure 4:
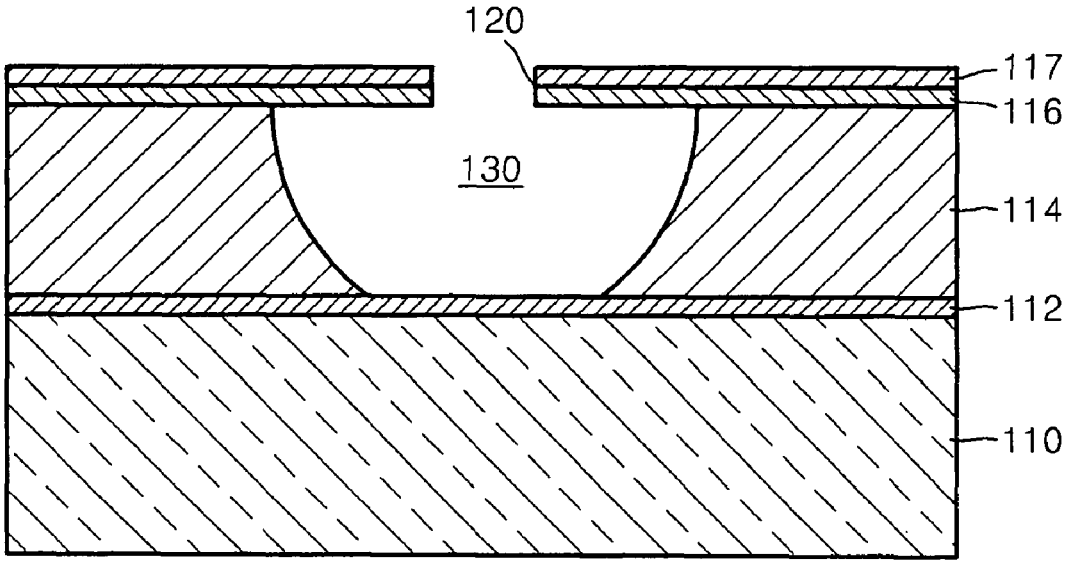

Referring to FIG. 3, a through hole 120 that exposes the insulating layer 114 is formed in the gate material layer 116 and the metal sacrificial layer 117. The through hole 120 can be formed by sequentially etching a predetermined portion of each of the metal sacrificial layer 117 and the gate material layer 116. The through hole 120 may be formed on a location corresponding to a location where an emitter 150 (refer to FIG. 9) is to be formed. Referring to FIG. 4, the emitter hole 130 that exposes the cathode electrode 112 is formed in the insulating layer 114. The emitter hole 130 can be formed by isotropically etching the insulating layer 114 until the cathode electrode 112 is exposed through the through hole 120.

Figure 5:
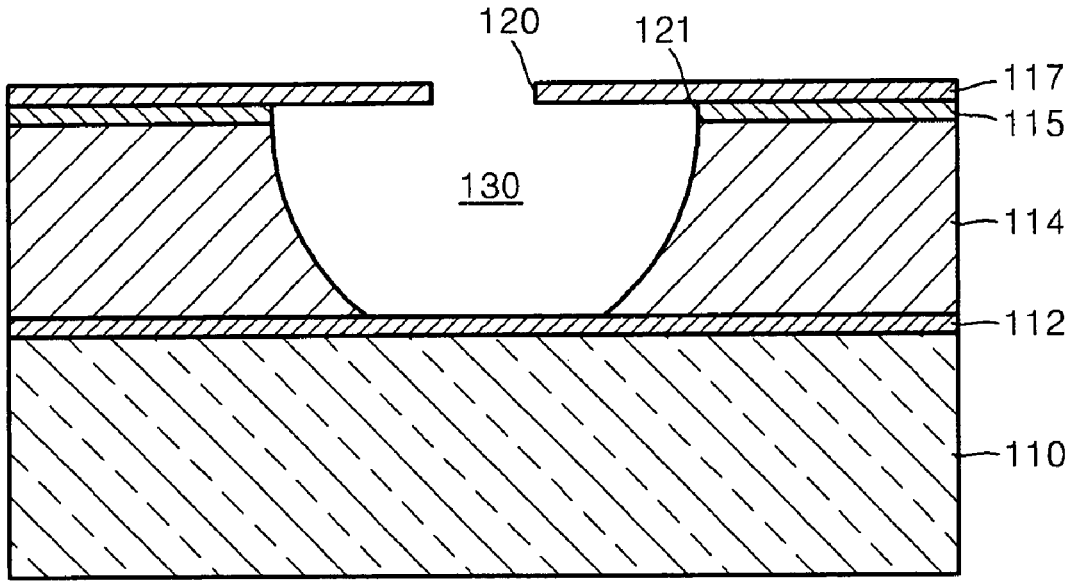

Referring to FIG. 5, the gate material layer 116 that constitutes an upper wall of the emitter hole 130 is removed using a predetermined etchant. As a result, a gate electrode 115 having a gate hole 121 that is connected to the emitter hole 130 is formed on an upper surface of the insulating layer 114. In the present embodiment, as described above, since the gate material layer 116 is formed of a material having etch selectivity with respect to the cathode electrode 112 and the metal sacrificial layer 117, the gate material layer 116 that constitutes an upper wall of the emitter hole 130 can only be removed using an etchant that does not etch the cathode electrode 112 and the metal sacrificial layer 117, however, only etches the gate material layer 116.

Figure 6:
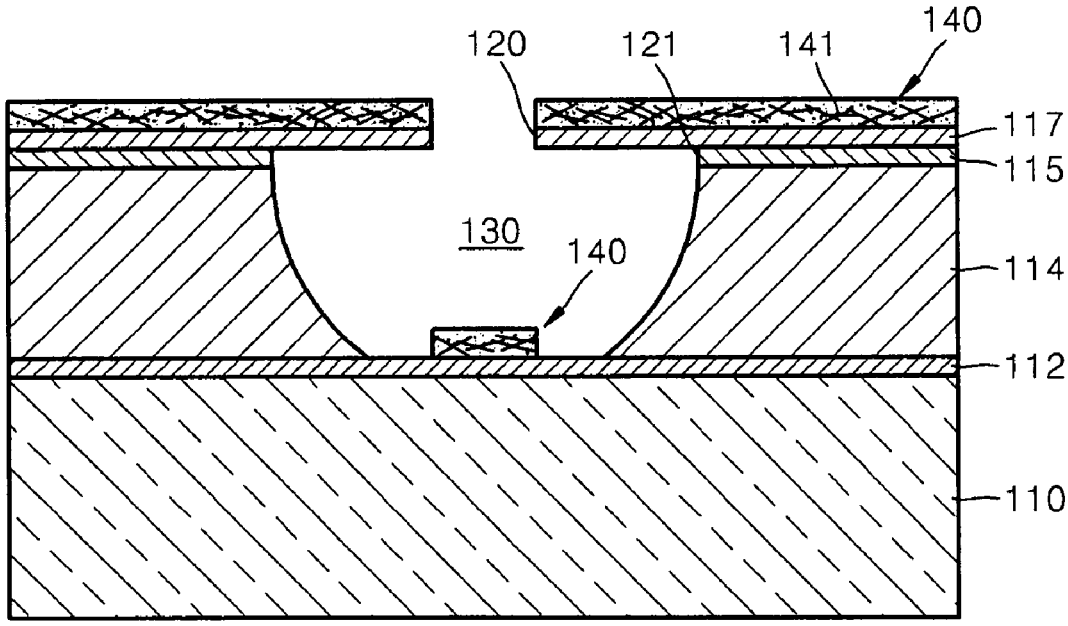

Referring to FIG. 6, a dispersion solution 140 is made by dispersing Carbon NanoTubes (CNTs) 141 in a predetermined solvent. The solvent can be at least one solution selected from the group consisting of water, dimethylformamide (DMF), N-methyl-2-pyrrolidone (NMP), dimethylacetamide (DMAc), cyclohexanon, ethylalcohol, chloroform, dichloromethane, and ethylether. The CNTs 141 can either be pure CNTs or CNTs combined with magnetic particles. The magnetic particles can be made of an alloy of iron. The dispersion solution 140 is coated on an upper surface of the metal sacrificial layer 117 and on an upper surface of the cathode electrode 112 located below the through hole 120. The coating of the dispersion solution 140 can be performed using a spray method or can be performed using various other methods, such as a spin coating method or a dipping method.

Figure 7:
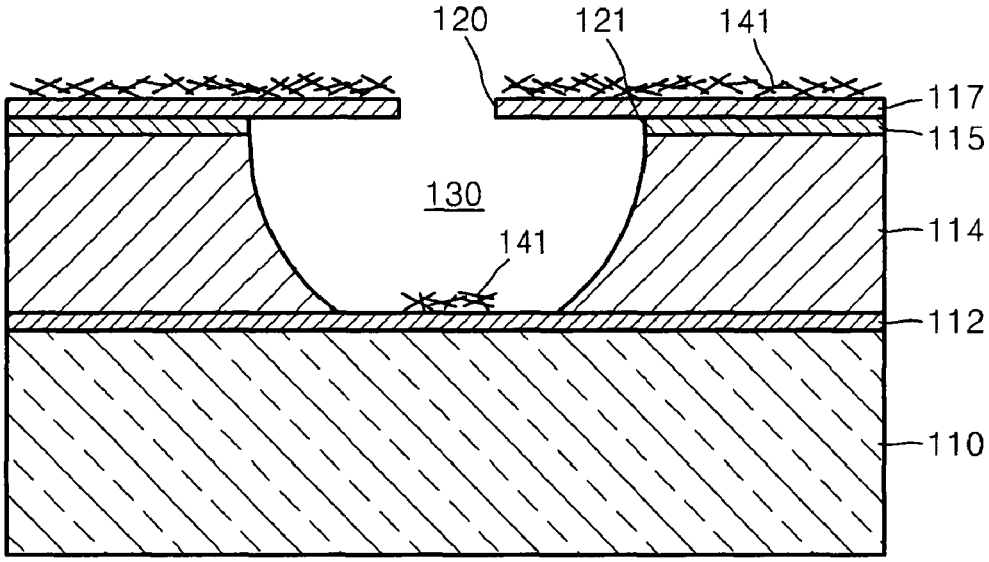

Referring to FIG. 7, the solvent from the dispersion solution 140 is removed through a heating process. Thus, only CNTs 141 remain on the upper surface of the metal sacrificial layer 117 and on the upper surface of the cathode electrode 112 located below the through hole 120.

Figure 8:
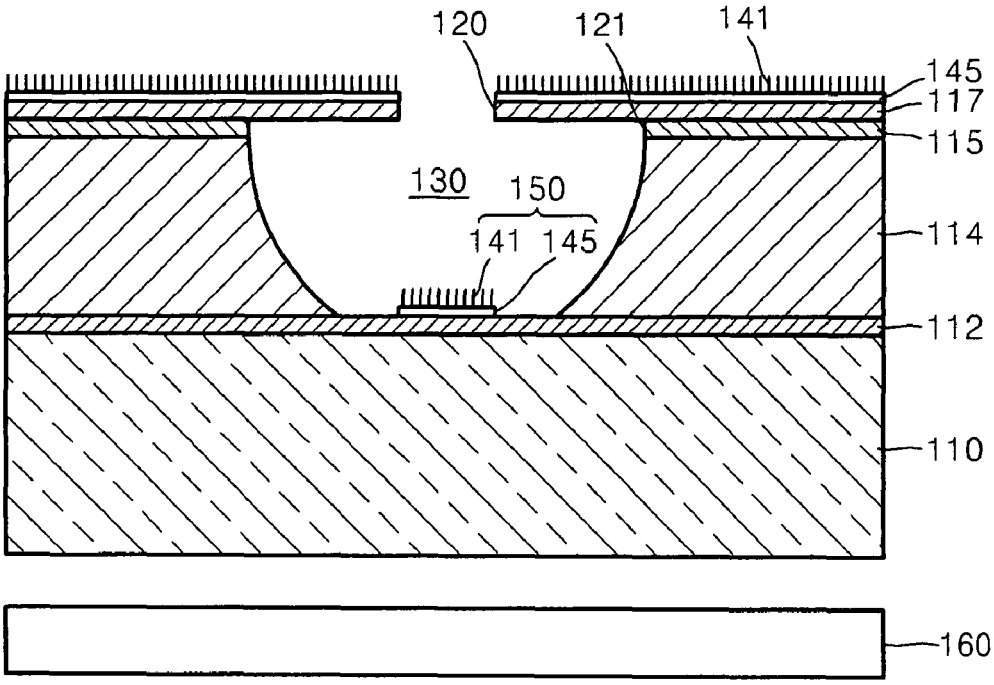

Referring to FIG. 8, if CNTs that are combined with magnetic particles are used as the CNTs 141, the CNTs 141 can be vertically aligned on surfaces of the cathode electrode 112 and the metal sacrificial layer 117 by applying a magnetic field to the CNTs 141. A magnetic field generation apparatus 160, such as a permanent magnet, for applying the magnetic field can be provided below the substrate 110. Then, an adhesion layer 145 can be deposited on the upper surfaces of the cathode electrode 112 and the metal sacrificial layer 117 when the CNTs 141 are vertically aligned. The adhesion layer 145 can be deposited using, for example, an electron beam deposition method, or can be deposited using various other deposition methods. The adhesion layer 145 fixes the CNTs 141 on the cathode electrode 112 and the metal sacrificial layer 117. The adhesion layer 145 can be formed of at least one metal selected from the group consisting of Ti, Mo, Au, Ag, Al, Ca, Cd, Fe, Ni, Pt, Zn, and Cu. Thus, an emitter 150 consisting of the adhesion layer 145 and the CNTs 141 that are vertically aligned on the adhesion layer 145 is formed on the upper surface of the cathode electrode 112 located on a central portion of the emitter hole 130. If pure CNTs are used as the CNTs 141, the CNTs 141 can be formed on the upper surfaces of the cathode electrode 112 and the metal sacrificial layer 117 without performing the process of vertically aligning the CNTs 141.

Figure 9:
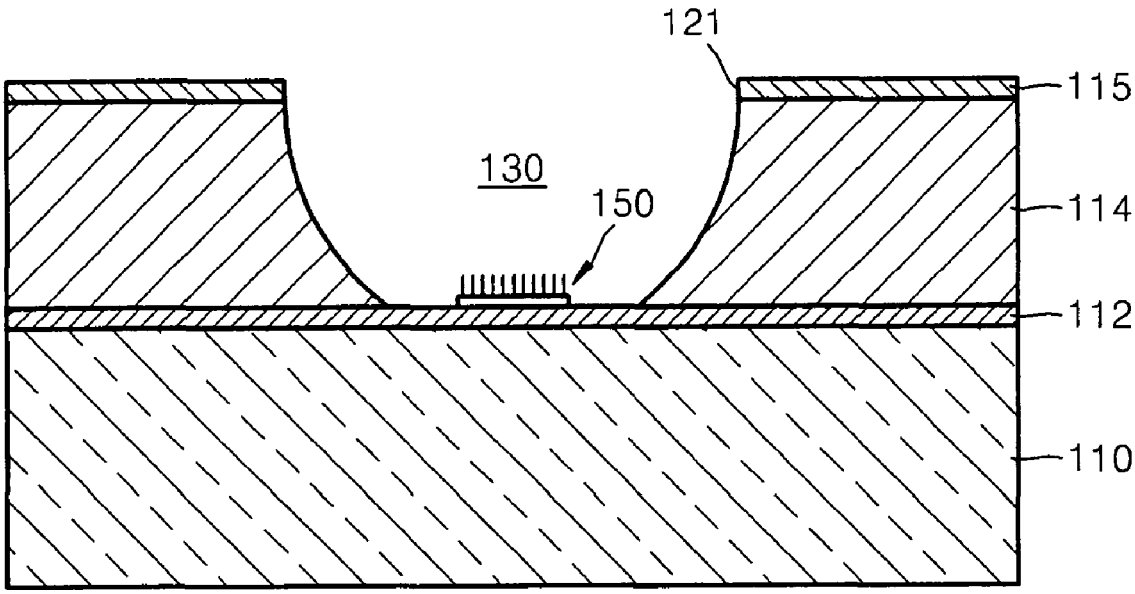

Finally, referring to FIG. 9, when the metal sacrificial layer 117 and the adhesion layer 145 and the CNTs 141 remaining on the metal sacrificial layer 117 are removed, then, only the emitter 150 remains on the upper surface of the cathode electrode 112 located on the central portion of the emitter hole 130.

As described above, in the method of manufacturing a field emission device according to an embodiment of the present invention, there is no possibility that the CNTs 141 that constitute the emitter 150 can be degraded since a carbon nanotube paste is not employed, and the uniformity of brightness can be increased since the emitter 150 can be correctly formed to be aligned with the center of the emitter hole 130 on the upper surface of the cathode electrode 112.

FIGS. 10 through 15 are cross-sectional views of a method of manufacturing a field emission device according to another embodiment of the present invention.

Figure 10:
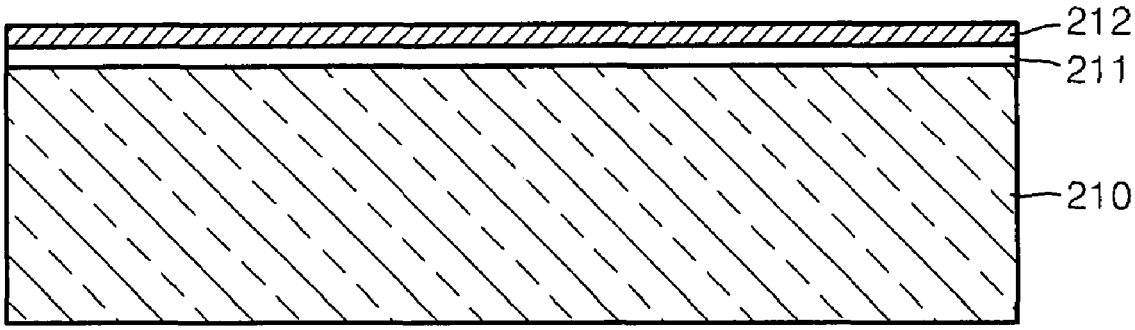
FIGS. 10 through 15 are cross-sectional views of a method of manufacturing a field emission device according to another embodiment of the present invention.

Referring to FIG. 10, a base electrode 211 and a cathode electrode 212 are sequentially formed on a substrate 210. The base electrode 211 and the cathode electrode 212 can be formed by respectively patterning a base material layer (not shown) and a cathode electrode material (not shown) to a predetermined shape, for example, a stripe shape after sequentially depositing the base material layer and the cathode electrode material on the substrate 210. The base electrode 211 can be formed of a transparent conductive material, such as indium tin oxide (ITO) or various other materials. The cathode electrode 212 can be formed of a metal, such as Cr, Ag, Al, or Au, or various other materials. In the present embodiment, the base electrode 211 may be formed of a material having etch selectivity with respect to the cathode electrode 212. For example, if the base electrode 211 is formed of ITO, the cathode electrode 212 may be formed of a material having etch selectivity to ITO, for example, Cr, Ag, Al, or Au.

Figure 11:
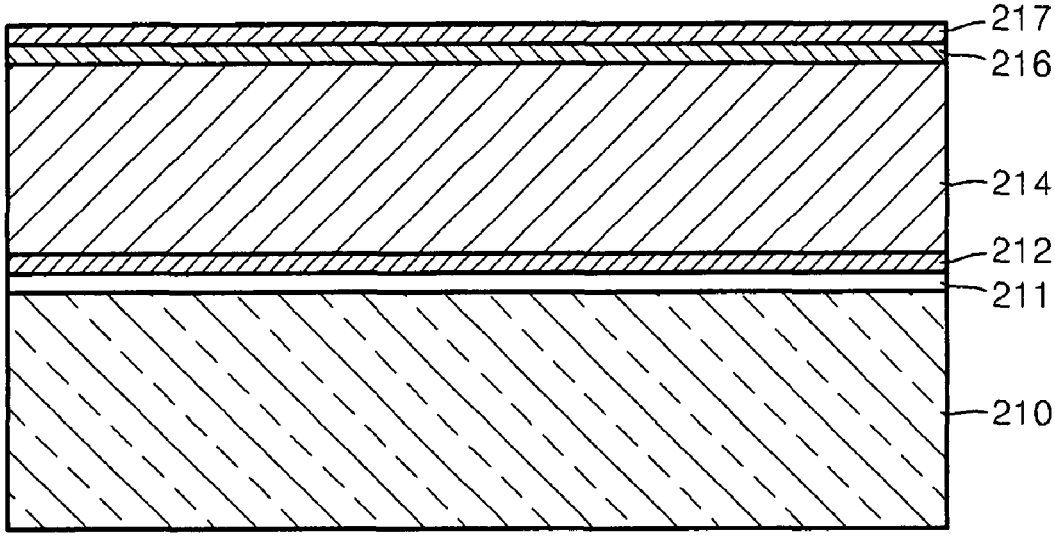

Referring to FIG. 11, after forming an insulating layer 214 covering the base electrode 211 and the cathode electrode 212 that is on the substrate 210 to a predetermined thickness, a gate material layer 216 and a metal sacrificial layer 217 are sequentially deposited on the insulating layer 214. The gate material layer 216 and the metal sacrificial layer 217 can be formed of, for example, Cr, Ag, Al, or Au, or can be formed of various other materials. In the present embodiment, the gate material layer 216 may be formed of a material not having etch selectivity with respect to the cathode electrode 212, however, having etch selectivity with respect to the base electrode 211 and the metal sacrificial layer 217. For example, if the cathode electrode 212 and the gate material layer 216 are formed of Cr, the base electrode 211 and the metal sacrificial layer 217 may be formed of a material having selectivity with respect to Cr.

Figure 12:
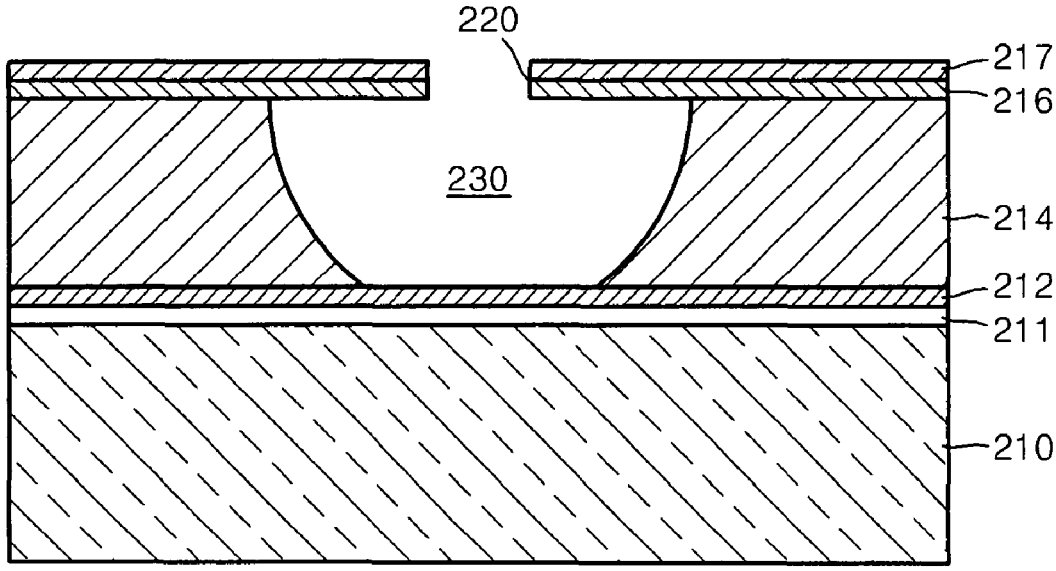

Referring to FIG. 12, a through hole 220 that exposes the insulating layer 214 is formed in the metal sacrificial layer 217 and the gate material layer 216. The through hole 220 can be formed by sequentially etching a predetermined portion of each of the metal sacrificial layer 217 and the gate material layer 216. In the present embodiment, the through hole 220 may be formed on a location corresponding to a location where an emitter 250 (refer to FIG. 15) is to be formed. Then, the emitter hole 230 that exposes the cathode electrode 212 is formed in the insulating layer 214. The emitter hole 230 can be formed by isotropically etching the insulating layer 214 until the cathode electrode 212 is exposed through the through hole 220.

Figure 13:
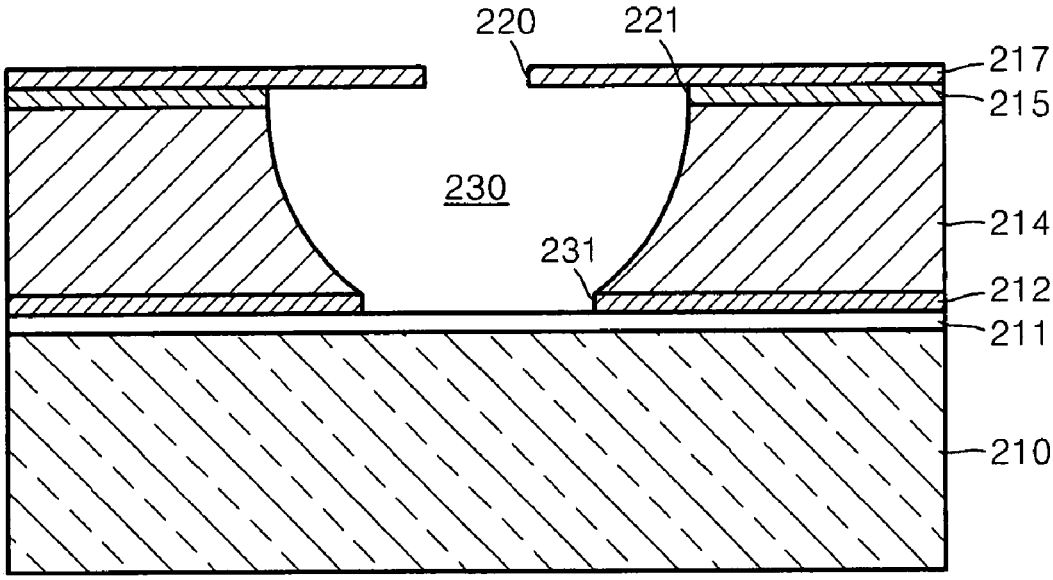

Referring to FIG. 13, the gate material layer 216 that constitutes an upper wall of the emitter hole 230 and the cathode electrode 212 that constitutes a lower wall of the emitter hole 230 are removed using a predetermined etchant. As a result, a gate electrode 215 having a gate hole 221 is formed on an upper surface of the insulating layer 214, and a cathode hole 231 that exposes the base electrode 211 is formed in the cathode electrode 212. In the present embodiment, as described above, since the gate material layer 216 is formed of a material not having etch selectivity with respect to the cathode electrode 212, however, having etch selectivity with respect to the base electrode 211 and the metal sacrificial layer 217, the gate material layer 216 and the cathode electrode 212 that respectively constitute an upper wall and a lower wall of the emitter hole 230 can only be removed using an etchant that does not etch the base electrode 211 and the metal sacrificial layer 217.

Figure 14:
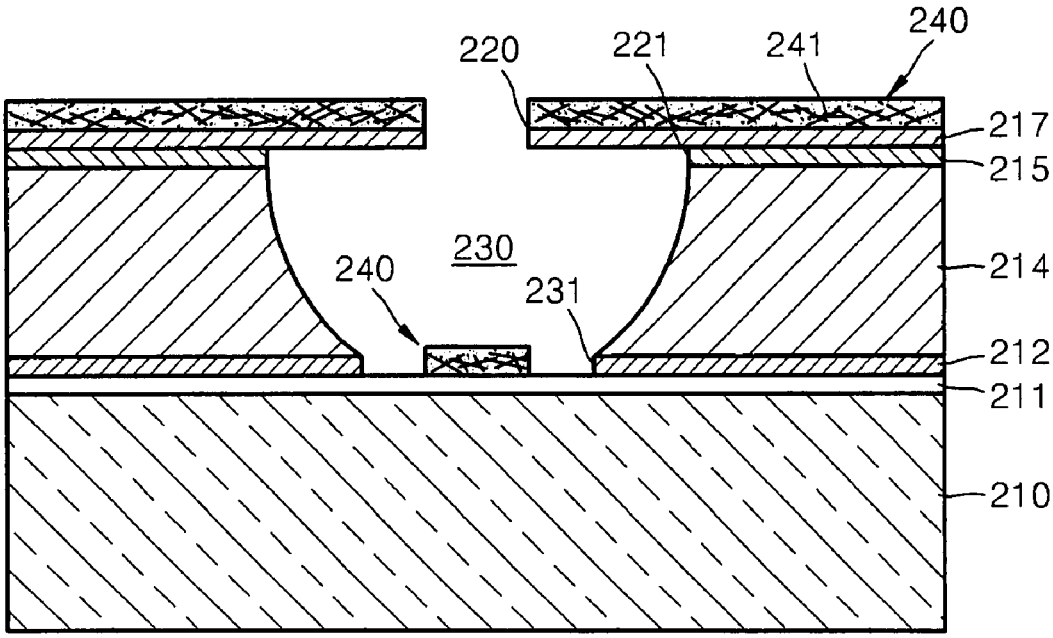

Referring to FIG. 14, a dispersion solution 240 is formed by dispersing Carbon NanoTubes (CNTs) 241 in apredetermined solvent, and then the dispersion solution 240 is coated on an upper surface of the metal sacrificial layer 217 and on an upper surface of the base electrode 211 located below the through hole 220. The solvent that is used for the dispersion solution 240 can be at least one solution selected from the group consisting of water, dimethylformamide (DMF), N-methyl-2-pyrrolidone (NMP), dimethylacetamide (DMAc), cyclohexanon, ethylalcohol, chloroform, dichloromethane, and ethylether. The CNTs 241 can be either pure CNTs or CNTs combined with magnetic particles. The magnetic particles can be made of an iron alloy. The coating of the dispersion solution 240 can be performed using a spray method, or can also be performed using various other methods such as a spin coating method or a dipping method.

The subsequent processes are identical to the previous embodiment, and accordingly, a detailed description thereof has not been repeated.

When the solvent is removed from the dispersion solution 240, only the CNTs 241 remain on the upper surfaces of the metal sacrificial layer 217 and the base electrode 211 located below the through hole 220. If CNTs combined with magnetic particles are used as the CNTs 241, the CNTs 241 can be vertically aligned on the surfaces of the base electrode 211 and the metal sacrificial layer 217 by applying a magnetic field to the CNTs 241. Then, an adhesion layer 245 can be deposited on the upper surfaces of the base electrode 211 and the metal sacrificial layer 217 using an electron beam deposition method when the CNTs 241 are vertically aligned on the upper surfaces of the base electrode 211 and the metal sacrificial layer 217. The adhesion layer 245 can be formed of at least one metal selected from the group consisting of Ti, Mo, Au, Ag, Al, Ca, Cd, Fe, Ni, Pt, Zn, and Cu. Thus, an emitter 250 consisting of the adhesion layer 245 and the CNTs 241 vertically aligned on the adhesion layer 245 is formed on the upper surface of the base electrode 211 positioned on the center portion of the emitter hole 230. If pure CNTs are used as the CNTs 241, the adhesion layer 245 can be formed on the upper surfaces of the base electrode 211 and the metal sacrificial layer 217 without performing the process of vertically aligning the CNTs 241.

Figure 15:
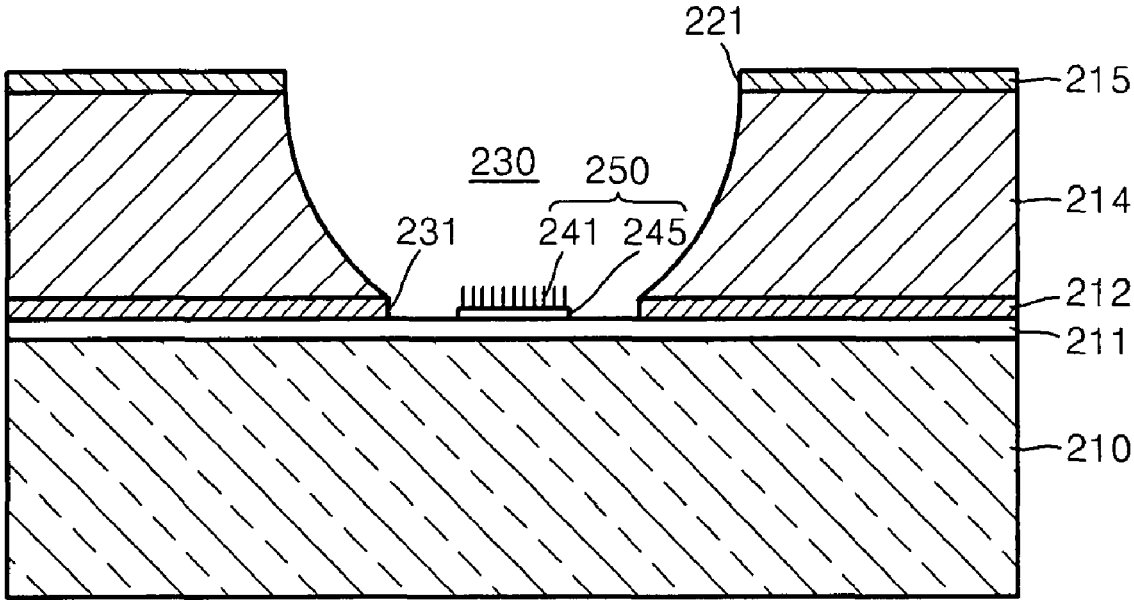

Referring to FIG. 15, when the metal sacrificial layer 217, and the adhesion layer 245 and the CNTs 241 remaining on the metal sacrificial layer 217 are removed, then, only the emitter 250 remains on the upper surface of the base electrode 211 located on a central portion of the emitter hole 230.As described above, according to the present invention, a CNT paste is not employed for manufacturing a field emission device. Therefore, there is no possibility that the CNTs can be degraded. Accordingly, the lifetime of the field emission device can be increased. Also, since an emitter can be correctly formed on the central portion of an emitter hole, brightness uniformity can be increased.

While the present invention has been particularly shown and described with reference to exemplary embodiments thereof, it will be understood by those of ordinary skill in the art that various modifications in form and detail may be made therein without departing from the spirit and scope of the present invention as defined by the following claims.

What is claimed is:

1. A method of manufacturing a field emission device, the method comprising:

sequentially forming a cathode electrode, an insulating layer, and a gate aterial layer on a substrate;

forming a metal sacrificial layer on an upper surface of the gate material layer;

forming a through hole to expose the insulating layer in the metal sacrificial layer and the gate material layer;

forming an emitter hole to expose the cathode electrode in the insulating layer exposed through the through hole;

forming a gate electrode by etching the gate material layer constituting an upper wall of the emitter hole through the through hole;

forming an emitter of carbon nanotubes (CNTs) on an upper surface of the cathode electrode located below the through hole using a dispersion solution including the CNTs; and forming a planar adhesion layer between the upper surface of the cathode electrode and the emitter of CNTs to fix the CNTs on the upper surface of the cathode electrode.

2. The method of claim 1, wherein the gate material layer is formed of a material having etch selectivity with respect to the cathode electrode and the metal sacrificial layer.

3. The method of claim 1, wherein the through hole is formed by etching a predetermined portion of each of the metal sacrificial layer and the gate material layer until the insulating layer is exposed.

4. The method of claim 3, wherein the through hole is formed at a location corresponding to a location where the emitter is formed.

5. The method of claim 1, wherein the emitter hole is formed by etching the insulating layer exposed by the through hole until the cathode electrode is exposed.

6. The method of claim 5, wherein the insulating layer is etched by an isotropical etching method.

7. The method of claim 1, wherein forming the emitter comprises:

forming CNTs on upper surfaces of the metal sacrificial layer and the cathode electrode located below the through hole; and removing the metal sacrificial layer and the CNTs formed on the upper surface of the metal sacrificial layer.

8. The method of claim 7, wherein the planar adhesion layer is formed after the CNTs have been formed.

9. The method of claim 8, wherein the adhesion layer is formed of at least one metal selected from a group consisting of Ti, Mo, Au, Ag, Al, Ca, Cd, Fe, Ni, Pt, Zn, and Cu.

10. The method of claim 8, wherein the adhesion layer is formed by an electron beam deposition method.

11. The method of claim 7, wherein forming the CNTs comprises:

preparing the dispersion solution formed by dispersing the CNTs in a solvent;

coating the dispersion solution on upper surfaces of the metal sacrificial layer and the cathode electrode located below the through hole; and removing the solvent by heating the dispersion solution.

12. The method of claim 11, wherein the solvent is at least one solution selected from a group consisting of water, dimethyl formamide (DMF), N-methyl-2-pyrrolidone (NMP), dimethyl acetamide (DMAc), cyclohexanone, ethyl alcohol, chloroform, dichloromethane, and ethyl ether.

13. The method of claim 11, wherein the dispersion solution is coated by one of a spray method, a spin coating method, or a dipping method.

14. The method of claim 11, wherein the CNTs comprise CNTs combined with magnetic particles.

15. The method of claim 14, wherein the magnetic particles are formed of an iron alloy.

16. The method of claim 14, further comprising vertically arranging the CNTs on the surface of the cathode electrode by applying a magnetic field to the CNTs after removing the solvent from the dispersion solution through a heating process.

17. The method of claim 16, wherein the magnetic field is applied by a permanent magnet arranged below the substrate.

18. The method of claim 16, further comprising forming the adhesion layer for fixing the CNTs on the upper surface of the cathode electrode after vertically arranging the CNTs.

19. A method of manufacturing a field emission device, the method comprising:

sequentially forming a base electrode, a cathode electrode, an insulating layer, and a gate material layer on a substrate;

forming a metal sacrificial layer on an upper surface of the gate material layer;

forming a through hole to expose the insulating layer in the metal sacrificial layer and the gate material layer;

forming an emitter hole to expose the cathode electrode in the insulating layer exposed through the through hole;

forming a cathode hole to expose the base electrode by etching the cathode electrode constituting a lower wall of the emitter hole and simultaneously forming a gate electrode by etching the gate material layer constituting an upper wall of the emitter hole through the through hole;

forming an emitter of carbon nanotubes (CNTs) on an upper surface of the base electrode located below the through hole using a dispersion solution including the CNTs; and forming a planar adhesion layer between the upper surface of the base electrode and the emitter of CNTs to fix the CNTs on the upper surface of the base electrode.

20. The method of claim 19, wherein the cathode electrode and the gate material layer are formed of a material having etch selectivity with respect to the base electrode and the metal sacrificial layer.

21. The method of claim 19, wherein the through hole is formed at a location corresponding to a location where the emitter is formed.

22. The method of claim 19, wherein forming the emitter comprises:

forming CNTs on upper surfaces of the metal sacrificial layer and the base electrode located below the through hole; and removing the metal sacrificial layer and the CNTs formed on the upper surface of the metal sacrificial layer.

23. The method of claim 22, wherein the planar adhesion layer is formed after the CNTs have been formed.

24. The method of claim 23, wherein the adhesion layer is formed of at least one metal selected from a group consisting of Ti, Mo, Au, Ag, Al, Ca, Cd, Fe, Ni, Pt, Zn, and Cu.

25. The method of claim 23, wherein the adhesion layer is formed by an electron beam deposition method.

26. The method of claim 22, wherein forming the CNTs comprises:

preparing the dispersion solution formed by dispersing the CNTs in a solvent;

coating the dispersion solution on upper surfaces of the metal sacrificial layer and the base electrode located below the through hole; and removing the solvent by heating the dispersion solution.

27. The method of claim 26, wherein the solvent is at least one solution selected from a group consisting of water, dimethyl formamide (DMF), N-methyl-2-pyrrolidone (NMP), dimethyl acetamide (DMAc), cyclohexanone, ethyl alcohol, chloroform, dichloromethane, and ethyl ether.

28. The method of claim 26, wherein the dispersion solution is coated by one of a spray method, a spin coating method, or a dipping method.

29. The method of claim 26, wherein the CNTs comprise CNTs combined with magnetic particles.

30. The method of claim 29, wherein the magnetic particles are formed of an iron alloy.

31. The method of claim 29, further comprising vertically arranging the CNTs on the surface of the base electrode by applying a magnetic field to the CNTs after removing the solvent from the dispersion solution through a heating process.

32. The method of claim 31, wherein the magnetic field is applied by a permanent magnet arranged below the substrate.

33. The method of claim 31, further comprising forming the adhesion layer to fix the CNTs on the upper surface of the base electrode after vertically arranging the CNTs.

* * * * *